US006741022B2

(12) United States Patent
Lee et al.

(10) Patent No.: US 6,741,022 B2
(45) Date of Patent: May 25, 2004

(54) SHRINKAGE BAND AND CATHODE RAY TUBE COMPRISING THE SAME

(75) Inventors: Jong-Han Lee, Suwon (KR); Hyang-Jin Ko, Suwon (KR); Sang-Ho Chun, Seongnam (KR); Young-Bin Im, Yangsan (KR)

(73) Assignee: Samsung SDI Co., Ltd., Suwon (KR)

( * ) Notice: Subject to any disclaimer, the term of this patent is extended or adjusted under 35 U.S.C. 154(b) by 135 days.

(21) Appl. No.: 09/999,596

(22) Filed: Nov. 15, 2001

(65) Prior Publication Data

US 2002/0070658 A1 Jun. 13, 2002

(30) Foreign Application Priority Data

Dec. 8, 2000 (KR) ..... 2000-74762
Mar. 14, 2001 (KR) ..... 2001-13235

(51) Int. Cl.[7] ..... H01J 29/88
(52) U.S. Cl. ..... 313/479; 313/402; 313/477 R
(58) Field of Search ..... 313/479, 477 R, 313/407, 402, 438, 239, 238, 242

(56) References Cited

U.S. PATENT DOCUMENTS 5,606,377 A * 2/1997 Swank ..... 313/477 R
6,483,233 B1 * 11/2002 Yasuda ..... 313/407

FOREIGN PATENT DOCUMENTS

JP 50-151059 * 12/1975 ..... H01J/29/07
JP 62-278743 * 12/1987

* cited by examiner

*Primary Examiner*—Vip Patel
*Assistant Examiner*—Sharlene Leurig
(74) *Attorney, Agent, or Firm*—Christie, Parker & Hale, LLP

(57) ABSTRACT

Disclosed are a shrinkage band and a cathode ray tube (CRT) comprising the same. The shrinkage band includes includes a pair of spaced apart parallel first sides, a pair of spaced apart parallel second sides perpendicular to the first sides, the second sides being longer than the first sides, and corner portions connecting the first and second sides such that the corner portions are provided at four corners of the shrinkage band, wherein the shrinkage band is configured to go around an outer circumference of a CRT face panel skirt to apply tension to the face panel, and wherein the first sides, the second sides, and the corner portions of the shrinkage band comprise two materials each having a different permeability.

19 Claims, 4 Drawing Sheets

SHRINKAGE BAND AND CATHODE RAY TUBE COMPRISING THE SAME

CROSS REFERENCE TO RELATED APPLICATION

This application claims the benefit of Korean Application Nos. 2000–74762 and 2001–13235 filed on Dec. 8, 2000 and Mar. 14, 2001, respectively, in the Korean Industrial Property Office, the disclosures of which are incorporated herein by reference.

BACKGROUND

1. Field

The present invention relates to a cathode ray tube, and more particularly, to a shrinkage band and a cathode ray tube comprising the same.

2. Background

A cathode ray tube (CRT) is a display device in which an electron beam emitted from an electron gun excites phosphors on a phosphor screen such that the phosphors emit light, thereby creating various images. A three-ray electron beam is deflected by a deflection yoke to provide a raster scan and is separated into red (R), green (G), and blue (B) phosphors by a shadow mask, which functions as a color selection apparatus, to create precise colors.

The three-ray electron beam emitted from the electron gun illuminates designated phosphors with an accurate raster scan by way of a deflected magnetic field which corresponds precisely to apertures of the shadow mask. However, the earth's magnetic field affects the movement of electrons within the CRT. That is, the earth's magnetic field affects convergence characteristics of the electron beams (the degree to which the three-ray electron beam is focused to a single point), raster position, and purity characteristics.

The earth's magnetic field includes both horizontal and vertical components, i.e., horizontal and vertical to the earth's surface, and the intensity of the earth's magnetic field varies depending on the geographical location and positioning of the CRT. The horizontal component of the earth's magnetic field in particular affects the path of the electron beam raster and convergence. It is therefore very advantageous to block the horizontal component of the earth's magnetic field.

Heretofore, an inner shield for blocking the earth's magnetic field has been mounted in the CRT. The inner shield reduces changes in the landing of the electron beams caused by the earth's magnetic field by approximately 50%. However, there has been little improvement in the area of effectively blocking the affect of the earth's magnetic field, and particularly the horizontal component of the earth's magnetic field on the electron beams directed toward the phosphor screen once they has passed the inner shield.

Referring to FIG. 1, a bulb defining the CRT includes a glass face panel, a funnel, and a neck, which are fused to form the bulb. Also, a shrinkage band 5 applying a predetermined tension is mounted on the bulb 3 around an outer circumference of the face panel 1. The shrinkage band 5 acts to prevent the scattering of glass if the bulb 3 implodes as a result of external impact.

With regard to the mounting of the shrinkage band 5, tape (not shown) is first applied to the area on the bulb 3 where the shrinkage band 5 will be positioned. Next, the shrinkage band 5 is heated to between 500 and 600° C. to expand the same. In this state, the shrinkage band 5 is placed around the bulb 3 and is then cooled, which causes the shrinkage band 5 to shrink. Accordingly, the shrinkage band 5 is mounted on the bulb 3, applying a predetermined tension thereto.

The shrinkage band 5 is typically made of low carbon steel, which is inexpensive and has a low permeability. However, besides its use to provide support to the bulb 3, the shrinkage band 5 has not been applied to improve the magnetic field characteristics of the CRT.

SUMMARY

In one aspect of the present invention, a shrinkage band for a cathode ray tube (CRT) includes a pair of spaced apart parallel first sides, a pair of spaced apart parallel second sides perpendicular to the first sides, the second sides being longer than the first sides, and corner portions connecting the first and second sides such that the corner portions are provided at four corners of the shrinkage band, wherein the shrinkage band is configured to go around an outer circumference of a CRT face panel skirt to apply tension to the face panel, and wherein the first sides, and the second sides, a different magnetic permeability.

In another aspect of the present invention, a cathode ray tub includes a bulb including a face panel having a screen portion and a skirt, a neck, and a funnel between the face panel and the neck, the face panel, the funnel, and the neck being integrally formed, a phosphor screen on an inside surface of the screen portion, an electron gun configured to emit a three-ray electron beam toward the phosphor screen, a deflection element mounted to an outer circumference of the funnel and configured to generate a deflecting magnetic field to deflect the electron beam, an inner shield mounted within the bulb such that the inner shield surrounds a path of the electron beam, the inner shield being configured to reduce the influence of the earth's magnetic field, and a shrinkage band mounted around an outer circumference of the skirt to apply tension to the face panel, the shrinkage band having a pair of spaced apart parallel first sides, a pair of spaced apart parallel second sides perpendicular to the first sides, the second sides being longer than the first sides, and corner portions connecting the first and second sides such that the corner portions are provided at four corners of the shrinkage band, wherein the first sides, the second sides, and the corner portions comprise two materials each having a different permeability.

It is understood that other aspects of the present invention will become readily apparent to those skilled in the art from the following detailed description, wherein is shown and described only exemplary embodiments of the invention, simply by way of illustration. As will be realized, the invention is capable of other and different embodiments, and its several details are capable of modifications in various respects, all without departing from the invention. Accordingly, the drawings and description are to be regarded as illustrative in nature, and not as restrictive.

BRIEF DESCRIPTION OF THE DRAWINGS

Aspects of the present invention are illustrated by way of example, and not by way of limitation, in the accompanying drawings in which like reference numerals refer to similar elements.

DETAILED DESCRIPTION

The detailed description set forth below in connection with the appended drawings is intended as a description of exemplary embodiments of the present invention and is not intended to represent the only embodiments in which the present invention can be practiced. The term "exemplary" used throughout this description means "serving as an example, instance, or illustration," and should not necessarily be construed as preferred or advantageous over other embodiments. The detailed description includes specific details for the purpose of providing a thorough understanding of the present invention. However, it will be apparent to those skilled in the art that the present invention may be practiced without these specific details. In some instances, well known structures and devices are shown in block diagram form in order to avoid obscuring the concepts of the present invention.

Figure 1:
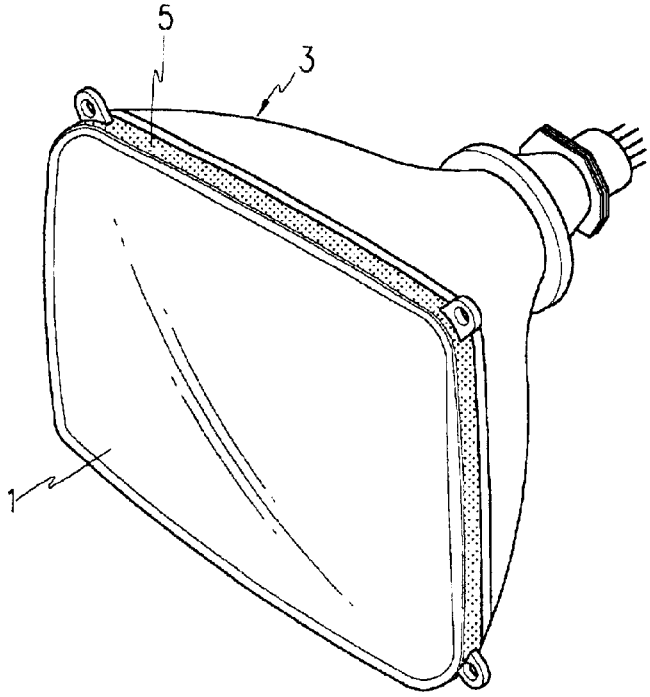
FIG.1 (Prior Art)
FIG. 1 is a perspective view of a prior art cathode ray tube.
Figure 2:
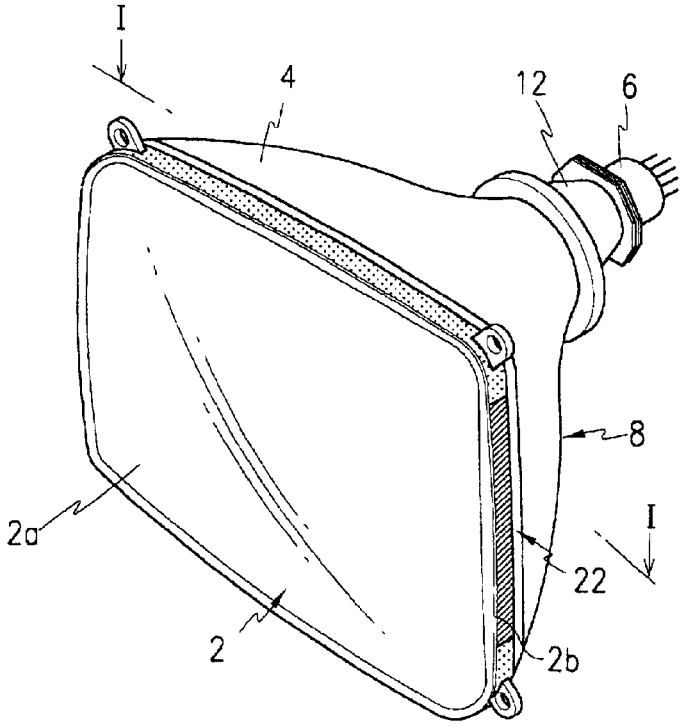
FIG. 2 is a perspective view of an exemplary cathode ray tube comprising a shrinkage band.
Figure 3:
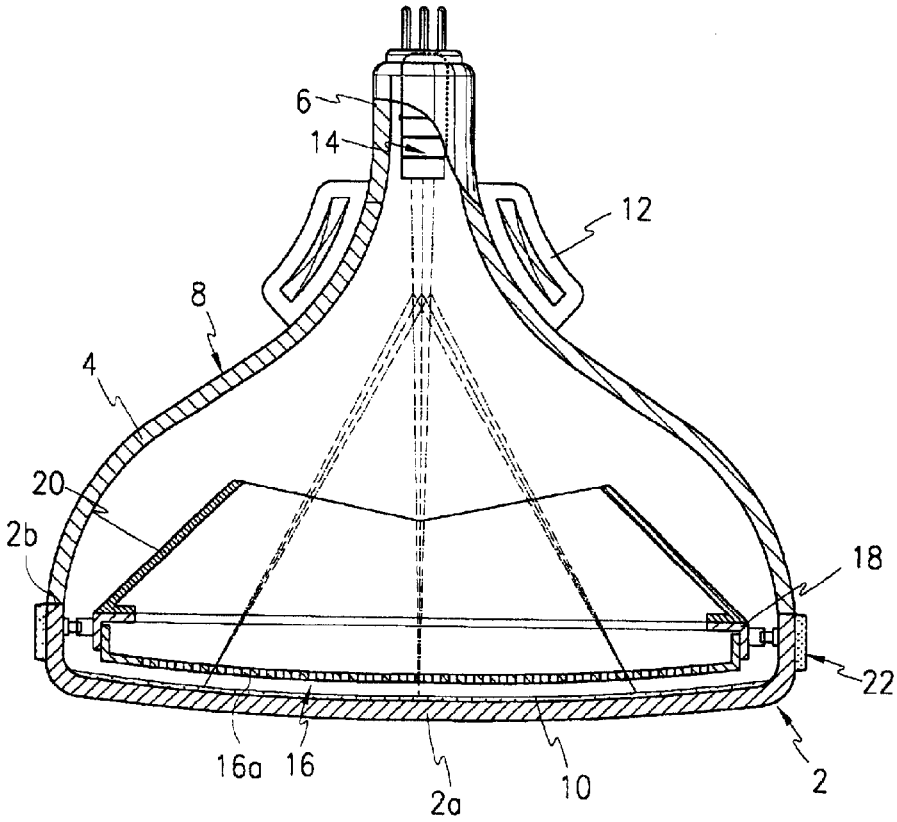
FIG. 3 is a view taken along line I—I of FIG. 2.

FIG. 2 is a perspective view of an exemplary cathode ray tube comprising a shrinkage band, and FIG. 3 is a view taken along line I—I of FIG. 2.

With reference to the drawings, a face panel 2, a funnel 4, and a neck 6 are fused to form a vacuum bulb 8. A phosphor screen 10 comprised of a plurality of R, G, and B pixels is formed at an inside surface of a screen portion 2*a* of the face panel 2. Also, a deflection yoke 12 is provided at a predetermined position on an outer surface of the funnel 4, and an electron gun 14 is mounted within the neck 6.

A shadow mask 16, which has a plurality of apertures 16*a* for the passage of electron beams, is suspended from a skirt 2*b* of the face panel 2 by a mask frame 18 such that the shadow mask 16 is spaced at a predetermined distance from the phosphor screen 10. An inner shield 20 is also mounted to the mask frame 18 such that it encompasses a path of electron beams emitted from the electron gun 14. Further, a shrinkage band 22 is mounted to an outer circumference of the skirt 2*b* of the face panel 2.

With the above structure, if a three-ray electron beam (depicted by the dotted lines in FIG. 3) corresponding to display signals is emitted from the electron gun 14, the electron beam is deflected by a magnetic field generated by the deflection yoke 12 toward a particular area of the phosphor screen 10, and then is separated into R, G, and B phosphors by passing through the apertures 16*a* of the shadow mask 16 to illuminate specific phosphors.

Although the inner shield 20 acts to block the earth's magnetic field, which alters the landing position of the electron beams, it is only approximately 50% effective, and once the electron beams pass the inner shield 20, the inner shield 20 is unable to provide its blocking function.

A shrinkage band 22 is provided with magnetic field characteristics to minimize the affect of the earth's magnetic field within the CRT on the path of the electron beams in the space between the inner shield and the phosphor screen. In particular, with the shrinkage band 22 having magnetic field characteristics, the horizontal components of the earth's magnetic field that affect electron beam convergence, raster position, and purity characteristics resulting from a change in location or position of the CRT, are blocked.

Figure 4:
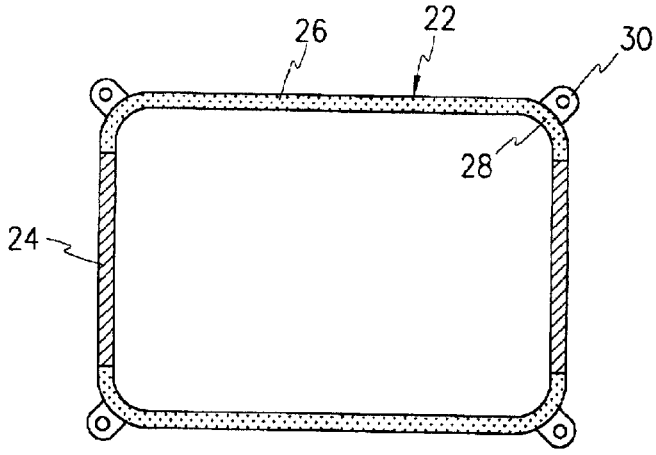
FIG. 4 is a front view of an exemplary shrinkage band.

One way to achieve this capability is with long sides of the shrinkage band 22 made of a material having a high magnetic permeability. With reference to FIG. 4, showing a front view of the exemplary shrinkage band 22, the shrinkage band 22 is substantially rectangular and includes a pair of short sides 24 provided in parallel in a vertical direction (in the drawing) and at a predetermined distance from each other, a pair long sides 26 provided in parallel in a horizontal direction (in the drawing) and at a predetermined distance from each other, and corner portions 28 provided at the four corners of the shrinkage band 22.

The long sides 26 and the corner portions 28 are made of a material having a high coercive force and high magnetic permeability, while the short sides 24 are made of a material having a low magnetic permeability. Mounted extending outwardly from the corner portions 28 by welding or some other such process are mounting tabs 30, which are fixed to a CRT cabinet (not shown).

The high magnetic permeability material used for the long sides 26 and the corner portions 28 of the shrinkage band 22 may be a nickel-iron alloy containing 70–90% by weight of nickel; a permalloy containing 40–80% by weight of nickel; or magnetic steel containing 0.01% or less by weight of carbon, 0.5–3.0% by weight of silicon, and the remaining percentage by weight of steel and impurities that are unavoidably present. Further, the low magnetic permeability material used for the short sides 24 may be a low carbon steel containing 0.12–0.2% by weight of carbon, for example, SPCC-1.

Figure 5:
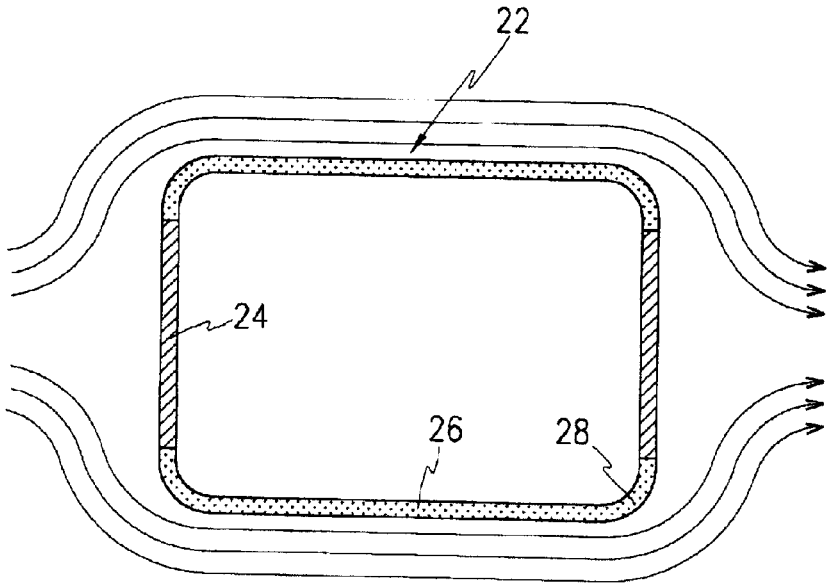
FIG. 5 is a schematic view showing the flow of horizontal components of the earth's magnetic field across the exemplary shrinkage band of FIG. 4.

With the long sides 26 and corner portions 28 of the shrinkage band 22 made of a material having a high magnetic permeability as described above, components of the earth's magnetic field horizontal to the earth's surface are directed by the permeability characteristics of the long sides 26 in a direction surrounding the outer circumference of the shrinkage band 22 as shown in FIG. 5. As a result, the shrinkage band 22 prevents the horizontal components of the earth's magnetic field from entering the CRT to thereby reduce the affect of the earth's magnetic field on the path of the electron beams.

Hence, the electron beams emitted from the electron gun 14 pass within the area defined by the inner shield 20 and form the designated rasters in a state whereby they are protected from the influence of the earth's magnetic field, then pass through this area toward the phosphor screen 10 where the shrinkage band 22 acts to effectively block the affect of the earth's magnetic field, and in particular the horizontal components of the earth's magnetic field.

Figure 6:
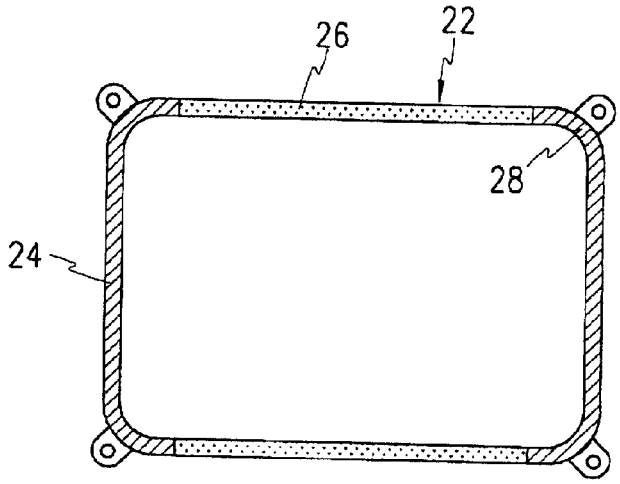
FIG. 6 is a front view of an exemplary shrinkage band.

FIG. 6 is a front view of an alternative exemplary shrinkage band. The shrinkage band 22 is substantially rectangular and includes a pair of short sides 24 provided in parallel in a vertical direction (in the drawing) and at a predetermined distance, a pair of long sides 26 provided in parallel in a horizontal direction (in the drawing) and at a predetermined distance, and corner portions 28 provided at the four corners of the shrinkage band 22.

The long sides 26 are made of a material of a high permeability, while the short sides 24 and the corner portions 28 are made of a material of a low permeability. The high permeability material and the low permeability material are identical to the materials described with reference to the previous exemplary shrinkage band.

Figure 7:
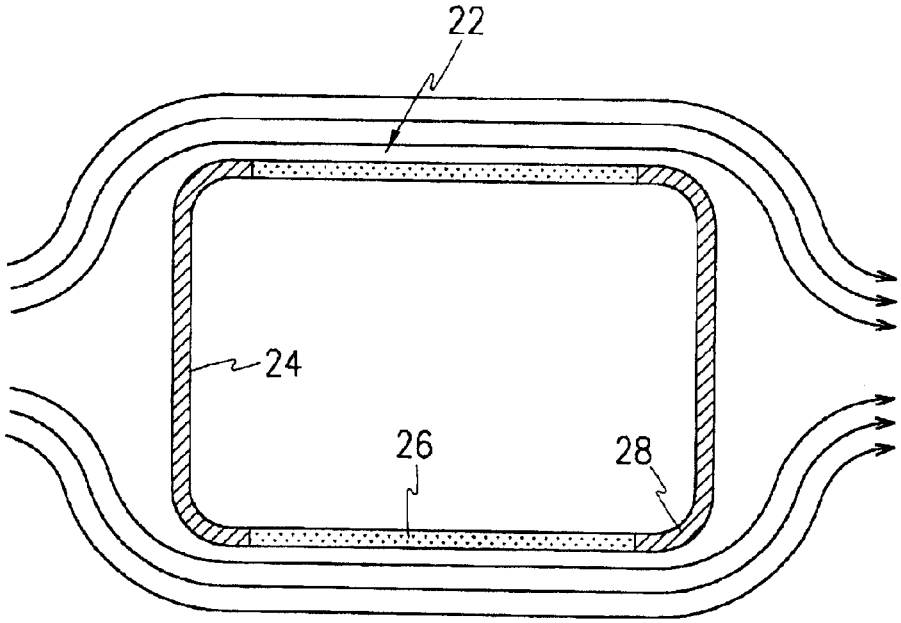
FIG. 7 is a schematic view showing the flow of horizontal components of the earth's magnetic field across the exemplary shrinkage band of FIG. 6.

As a result, with reference to FIG. 7, the horizontal components of the earth's magnetic field, rather than penetrating the shrinkage band 22 and entering the CRT, are directed by the permeability characteristics of the long sides 26 in a direction surrounding the outer circumference of the shrinkage band 22. Therefore, the shrinkage band 22 prevents the horizontal components of the earth's magnetic field from entering the CRT to thereby reduce the affect of the earth's magnetic field on the path of the electron beams.

The shrinkage band 22 is assembled by welding or otherwise fixedly connecting various members of differing materials. The shrinkage band 22 is then heated to thermally expand the same, after which the shrinkage band 22 is placed on the bulb 8 in this expanded state, that is, the shrinkage band 22 is placed around the outer circumference of the skirt 2*b* of the face panel 2. Next, the shrinkage band 22 is cooled such that it contracts, thereby resulting in the shrinkage band 22 being fixedly positioned around the skirt 2*b* of the face panel 2 to apply a predetermined tension thereto.

Although exemplary embodiments of the present invention has been described, it should not be construed to limit the scope of the appended claims. Those skilled in the art will understand that various modifications may be made to the described embodiments. Moreover, to those skilled in the various arts, the inventive aspect described herein may suggest solutions to other tasks and adaptions for other applications. It is therefore desired that the present embodiments be considered in all respects as illustrative and not restrictive, reference being made to the appended claims rather than the foregoing description to indicate the scope of the invention.

What is claimed is:

1. A shrinkage band for a cathode ray tube (CRT), comprising:

a pair of spaced apart parallel first sides;

a pair of spaced apart parallel second sides perpendicular to the first sides, the second sides being longer than the first sides; and corner portions connecting the first and second sides such that the corner portions are provided at four corners of the shrinkage band;

wherein the shrinkage band is configured to go around an outer circumference of a CRT face panel skirt to apply tension to the face panel, and wherein the first sides have a different magnetic permeability from that of the second sides.

2. The shrinkage band of claim 1 wherein the first sides comprise a material having a first permeability, and the second sides and the corner portions comprise a material having a second permeability higher than the first magnetic permeability.

3. The shrinkage band of claim 2 wherein the second material comprises nickel-iron alloy containing 70–90% by weight of nickel.

4. The shrinkage band of claim of claim 2 wherein the second material comprises magnetic steel alloy containing 0.01% or less by weight of carbon, 0.5–3.0% by weight of silicon, and the remaining percentage by weight of steel.

5. The shrinkage band of claim 2 wherein the first material comprises low carbon steel containing 0.12–0.2% by weight of carbon.

6. The shrinkage band of claim 1 wherein the first sides and the corner portions comprise a first magnetic permeability, and the second sides comprise a second magnetic permeability higher than the first magnetic permeability.

7. The shrinkage band of claim 6 wherein the second material comprises nickel-iron alloy containing 70–90% by weight of nickel.

8. The shrinkage band of claim of claim 6 wherein the second material comprises magnetic steel alloy containing 0.01% or less by weight of carbon, 0.5–3.0% by weight of silicon, and the remaining percentage by weight of steel.

9. The shrinkage band of claim 6 wherein the first material comprises low carbon steel containing 0.12–0.2% by weight of carbon.

10. A cathode ray tube, comprising:

a bulb including a face panel having a screen portion and a skirt, a neck, and a funnel between the face panel and the neck, the face panel, the funnel, and the neck being integrally formed;

a phosphor screen on an inside surface of the screen portion;

an electron gun configured to emit a three-ray electron beam toward the phosphor screen;

a deflection element mounted to an outer circumference of the funnel and configured to generate a deflecting magnetic field to deflect the electron beam;

an inner shield mounted within the bulb such that the inner shield surrounds a path of the electron beam, the inner shield being configured to reduce the influence of the earth's magnetic field; and a shrinkage band mounted around an outer circumference of the skirt to apply tension to the face panel, the shrinkage band comprising a pair of spaced apart parallel first sides, a pair of spaced apart parallel second sides perpendicular to the first sides, the second sides being longer than the first sides, and corner portions connecting the first and second sides such that the corner portions are provided at four corners of the shrinkage band, wherein the first sides have a different magnetic permeability from that of the second sides.

11. The cathode ray tube of claim 10 wherein the corner portions of the shrinkage band comprise the second material having the second magnetic permeability higher than the first magnetic permeability.

12. The cathode ray tube of claim 11 wherein the second material comprises nickel-iron alloy containing 70–90% by weight of nickel.

13. The cathode ray tube of claim of claim 11 wherein the second material comprises magnetic steel alloy containing 0.01% or less by weight of carbon, 0.5–3.0% by weight of silicon, and the remaining percentage by weight of steel.

14. The cathode ray tube of claim 11 wherein the first material comprises low carbon steel containing 0.12–0.2% by weight of carbon.

15. The cathode ray tube of claim 10 wherein the first sides and the corner portions of the shrinkage band comprise a first permeability, and the second sides of the shrinkage band comprise a second magnetic permeability higher than the first magnetic permeability.

16. The cathode ray tube of claim 15 wherein the second material comprises nickel-iron alloy containing 70–90% by weight of nickel.

17. The cathode ray tube of claim 15 wherein the second material comprises magnetic steel alloy containing 0.01% or less by weight of carbon, 0.5–3.0% by weight of silicon, and the remaining percentage by weight of steel.

18. The cathode ray tube of claim 15 wherein the first material comprises low carbon steel containing 0.12–0.2% by weight of carbon.

19. The shrinkage band of claim 1 wherein the first sides comprise a different magnetic permeability from that of the second sides.

* * * * *